United States Patent [19]

Stuitje

[11] Patent Number: 4,878,479

[45] Date of Patent: Nov. 7, 1989

[54] APPARATUS FOR EXHAUSTING THE COMBUSTION GASES OF A STOVE FIRED ON LIQUID OR GASEOUS FUEL

[76] Inventor: Cornelis C. Stuitje, Johan van Oldenbarneveldlaan 27, 3705 HA, Zeist, Netherlands

[21] Appl. No.: 241,057

[22] Filed: Sep. 6, 1988

[30] Foreign Application Priority Data

Sep. 3, 1987 [NL] Netherlands ..... 8702075

[51] Int. Cl.[4] ..... F24C 15/20

[52] U.S. Cl. ..... 126/84; 126/96; 165/901

[58] Field of Search ..... 126/80, 84, 92–95, 126/299 D, 299 R, 300–302, 99 R, 97, 104 R, 116 R; 98/115.1, 115.3, 46; 110/162; 165/901, 903, 904; 431/316, 315, 344

[56] References Cited

U.S. PATENT DOCUMENTS

| | | | |
|---|---|---|---|
| 413,367 | 10/1889 | Hilby | 126/303 |
| 3,827,343 | 8/1974 | Darm | 126/299 D |
| 4,424,792 | 1/1984 | Shimek et al. | 126/80 |

FOREIGN PATENT DOCUMENTS

| | | | |
|---|---|---|---|
| 60125 | 4/1982 | Japan | 126/80 |

*Primary Examiner*—James C. Yeung

*Attorney, Agent, or Firm*—Kane, Dalsimer, Sullivan, Kurucz, Levy, Eisele and Richard

[57] ABSTRACT

Apparatus for exhausting the combustion gases of a stove with open combustion fired on liquid or gaseous fuel. A collector hood is mounted above the combustion gas outlet of the stove. A heat exchanger is connected to the collector hood. A fan exhausts the combustion gases through the heat exchanger to the exterior of the room to be heated.

9 Claims, 2 Drawing Sheets

APPARATUS FOR EXHAUSTING THE COMBUSTION GASES OF A STOVE FIRED ON LIQUID OR GASEOUS FUEL

The invention relates to an apparatus for exhausting the combustion gases of a stove with open combustion fired on liquid or gaseous fuel.

The last years stoves with open combustion, in particular stoves with a double combustion system, are frequently used for heating living and hobby rooms. These stoves mostly fired on paraffin are characterized by high efficiency. The disadvantage of such stoves with open combustion is that the combustion gases are exhausted into the room to be heated. This renders the air in the heated room very humid and in course of time the windows get black. One has tried to avoid the disadvantages of these stoves by exhausting the combustion gases to the exterior of the room to be heated. This, however, strongly lowers the efficiency of the stove.

The invention has the object of providing an apparatus of the kind referred to above but avoiding the mentioned disadvantages in a simple and still efficient way.

For this purpose, the apparatus of the invention is characterized by a collector hold to be mounted above the combustion gas outlet of the stove, a heat exchanger connected to the collector hood and a fan for exhausting the combustion gases through the heat exchanger to the exterior of the room to be heated.

In this manner the combustion gases are exhausted to the exterior of the room to be heated and the heat which is present in these combustion gases by the heat exchanger is given off to the ambient air in the room to be heated.

Preferably the front side of the collector hood has a greater length than the rear side. It is thereby achieved that the combustion gases rising at the front side of the stove may be indeed collected by the collector hood.

In an advantageous embodiment of the invention a suction pipe is disposed in the collector hood and includes uniformly distributed over its length a number of holes and has open ends directed towards the front side of the collector hood.

In accordance with the invention it is possible that a connecting pipe connects the heat exchanger to the collector hood and the heat exchanger is disposed at a distance behind the collector hood. The heat exchanger thus will be positioned behind the stove so as to be for the greater part out of sight. For this purpose, preferably, the length of the heat exchanger at most is equal to the length of the front side of the collector hood.

The invention hereinafter will be further explained by way of the drawings showing an embodiment.

Figure 1:
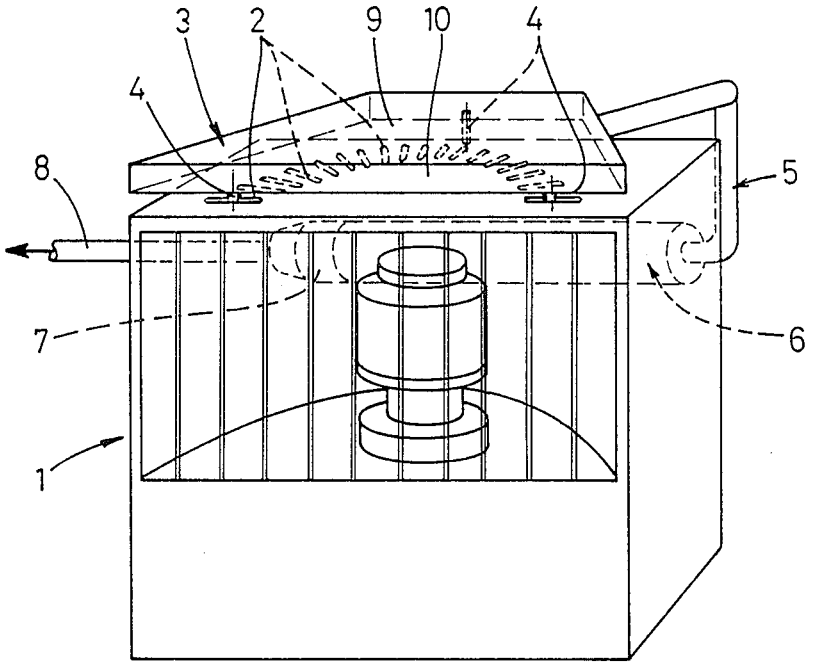
FIG. 1 is a schematic perspective view of an embodiment of the apparatus of the invention, which is mounted on a paraffin fired stove with open combustion and double combustion system.
Figure 3:
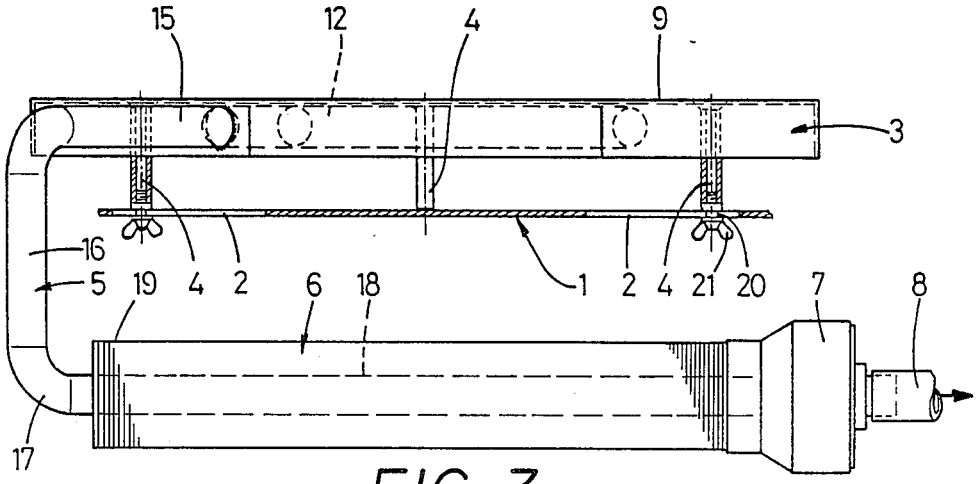
FIG. 3 is a rear view of the apparatus of FIG. 1.
Figure 2:
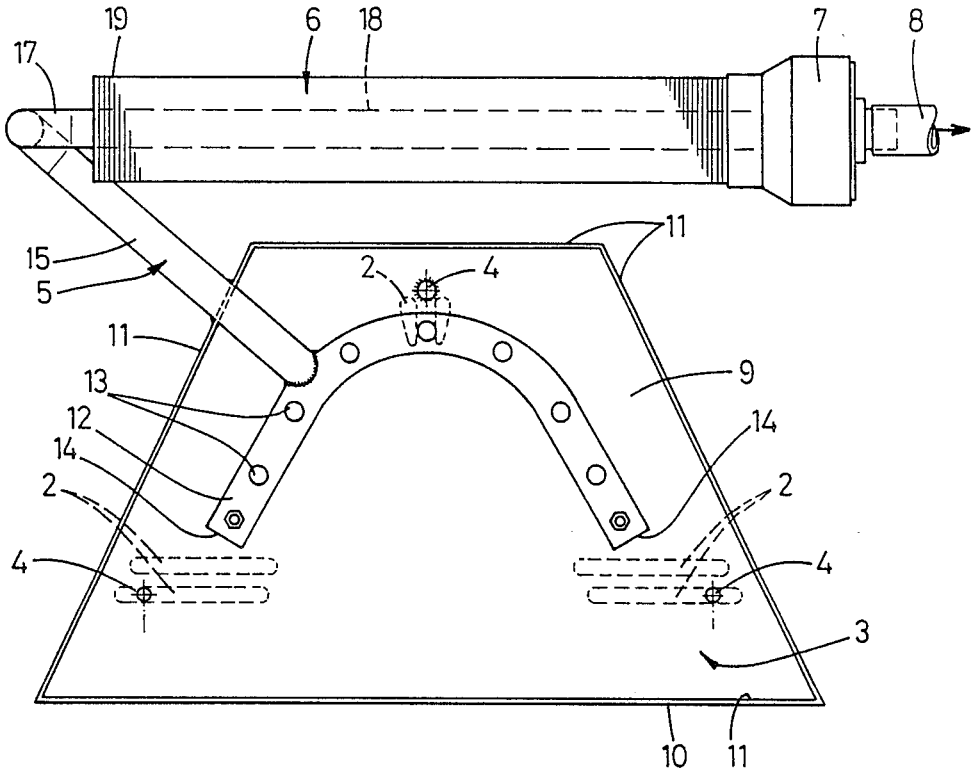
FIG. 2 is a bottom view of the apparatus of FIG. 1.

FIG. 1 schematically shows a paraffin fired stove 1 with open combustion and with a double combustion system. The upper wall of the stove 1 includes slots 2 through which the combustion gases are mainly exhausted. The stove 1 includes an apparatus for exhausting these combustion gases out of the room to be heated. This apparatus includes a collector hood 3 mounted at some distance above the upper wall of the stove 1 by mounting brackets 4. A connecting pipe 5 connects a heat exchanger 6 to the collector hood 3, and to the heat exchanger 6 follows a fan 7 which discharges the combustion gases after passing the heat exchanger 6 through an exhaust tube 8 or the like to the exterior of the room to be heated.

The collector hood 3 has a closed upper plate 9 in the shape of an isosceles trapezium having its base 10 at the front side. On the upper plate 9 are fastened downward side walls 11. In the collector hood 3 is mounted a suction pipe 12 to which the connecting pipe 5 of the heat exchanger 6 is connected. The suction pipe 12 has uniformly distributed over the length a number of holes 13 and furthermore has open ends 14 directed towards the front side 10 of the collector hood 3. The holes 13 have a smaller diameter than the open ends 14. Due to the great length of the front side 10 of the collector hood 3 and the enhanced suction at the front side 10 the combustion gases rising along the front side of the stove 1 also are collected by the collector hood 3 and exhausted through the heat exchanger 6.

The connecting pipe 5 comprises a rearwardly slanting portion 15 and joined thereto a downward portion 16 to which the heat exchanger 6 is connected through a 90° -bend 17. The heat exchanger 6 so lies in the mounted position of the described apparatus behind the stove 1 as illustrated in FIG. 1 so as to be for the greater part out of sight. Furthermore the heat exchanger 6 so is disposed at a relatively cool location so as to guarantee an optimal operation of the heat exchanger 6.

The heat exchanger 6 comprises a pipe 18 with a great number of schematically represented annular fins 19. The length of the heat exchanger 6 is somewhat smaller than the length of the front side 10 of the collector hood 3. The heat exchanger 6 in the mounted position thereby is nearly entirely kept out of sight by the stove 1.

The mounting brackets 4 at the front side 10 of the collector hood 3 have a threaded end 20 which may be inserted through the front slots 2 of the upper wall of the stove 1 to be fastened at that location by a wing nut 21.

At the lower side of the collector hood 3 a distribution grate may be arranged, if desired.

The described apparatus for exhausting the combustion gases of the stove 1 has the advantage that the combustion gases of the stove 1 no longer arrive into the room to be heated and that the efficiency of the stove by using the heat exchanger 6 is maintained. The disadvantages of stoves with open combustion, as very high humidity of the air in the room to be heated, windows getting block, pollution of the air and the like thereby are entirely avoided. As the collector hood 3 is spaced at some distance above the upper wall of the stove, the stove 1 also can stay operating with the fan 7 switched off without danger, since the heat then is carried away via the intermediate space.

Although the embodiment shown in the drawing relates to an apparatus according to the invention which is mounted on a paraffin fired stove, the invention is by no means restricted thereto.

The apparatus according to the invention is equally suitable for integrated application in heating apparatuses fired with oil, gas or other hydrocarbons.

It is also conceivable that besides the said energy carriers other fuels may be used, such as solid fuels.

The invention is not limited to the preceding embodiment, which can be varied in different ways within the scope of the invention.

I claim:

1. Apparatus for exhausting the combustion gases of a stove with open combustion fired on liquid or gaseous fuel, said stove having an upper wall with a plurality of combustion gas outlet means, said apparatus comprising a collector hood, having a closed upper wall and a downwardly directed open under side, means for detachably mounting the collector hood on top of the upper wall of the stove with its open under side covering said combustion gas outlet means, a heat exchanger, means connecting the heat exchanger to the collector hood, an exhaust tube for exhausting the combustion gases, and a fan for providing a flow of combustion gases from the collector hood through said connecting means and said heat exchanger to said exhaust tube.

2. Apparatus according to claim 1, wherein said collector hood includes a front side and a rear side, said front side having a greater length than said rear side.

3. Apparatus according to claim 2, further comprising a suction pipe disposed in said collector hood, said suction pipe including a number of holes uniformly distributed along its length and having open ends directed to the front side of the collector hood, said suction pipe being connected to said connecting means.

4. Apparatus according to claim 3, wherein said holes have a diameter which is smaller than the diameter of said open ends of the suction pipe.

5. Apparatus according to claim 2, wherein said connecting means includes a connecting pipe which mechanically couples the heat exchanger to the collector hood in such a manner that the heat exchanger is disposed at a distance behind the rear side of the collector hood.

6. Apparatus according to claim 5, wherein the heat exchanger has a length which is at most equal to the length of the front side of the collector hood.

7. Apparatus according to claim 1, wherein said heat exchanger includes a pipe connected to said connecting means and said exhaust tube and said heat exchanger is provided with annular fins.

8. Apparatus according to claim 1, wherein said mounting means includes a plurality of mounting brackets adapted to mount the collector hood at a distance above the upper wall of the stove.

9. Apparatus according to claim 1, further comprising a distribution grate mounted in said collector hood.

* * * * *